US007128594B2

(12) United States Patent
O'Connor et al.

(10) Patent No.: US 7,128,594 B2
(45) Date of Patent: Oct. 31, 2006

(54) SNAGLESS TELECOMMUNICATIONS PLUG ASSEMBLY

(75) Inventors: Douglas P. O'Connor, Swansea, MA (US); Glenn T. Kierstead, Coventry, CT (US)

(73) Assignee: Hubbell Incorporated, Orange, CA (US)

( * ) Notice: Subject to any disclaimer, the term of this patent is extended or adjusted under 35 U.S.C. 154(b) by 0 days.

(21) Appl. No.: 10/804,210

(22) Filed: Mar. 19, 2004

(65) Prior Publication Data

US 2005/0208816 A1 Sep. 22, 2005

(51) Int. Cl.
*H01R 13/625* (2006.01)

(52) U.S. Cl. ..... 439/344; 439/352

(58) Field of Classification Search ..... 439/352, 439/344, 354, 357, 447, 676; 385/60, 72, 385/78, 86

See application file for complete search history.

(56) References Cited

U.S. PATENT DOCUMENTS 4,611,875 A 9/1986 Clarke
5,494,457 A 2/1996 Kunz
5,613,869 A 3/1997 Erlich
5,638,474 A 6/1997 Lampert
5,685,731 A 11/1997 Lin
5,993,236 A 11/1999 Vanderhoof
D420,329 S 2/2000 Lin
6,210,200 B1 4/2001 Kranzdorf
6,375,496 B1 4/2002 Casey
6,398,576 B1 6/2002 Hwang
D477,571 S * 7/2003 Huang et al. ..... D13/147
6,752,538 B1 * 6/2004 Bates, III ..... 385/78

* cited by examiner

*Primary Examiner*—Alexander Gilman
(74) *Attorney, Agent, or Firm*—Alfred N. Goodman; Mark S. Bicks; Marcus R. Mickney

(57) ABSTRACT

A snagless telecommunications connector assembly is quickly and easily disengageable from a complementary mating connector assembly. A connector housing has front and rear ends, and an upper surface extending between the front and rear ends adjacent and above the upper surface. A latch beam extends rearwardly from the front end of the connector housing. The latch beam is deflectable to disengage the connector assembly from a complementary mating connector assembly. First and second ears extend outwardly from the upper surface of the connector housing. Each of the first and second ears has a portion tapering toward the rear end of the housing to prevent snagging the latch beam. A rib extends outwardly from the latch beam to further prevent snagging of the latch beam.

20 Claims, 4 Drawing Sheets

SNAGLESS TELECOMMUNICATIONS PLUG ASSEMBLY

FIELD OF THE INVENTION

The present invention relates to a snagless telecommunications connector assembly. More particularly, the present invention relates to a snagless telecommunications plug assembly having first and second ears on the plug body and a rib on a latch beam between the first and second ears. Still more particularly, the present invention relates to a telecommunications plug assembly in which a rib on a latch beam extends above the highest point of first and second ears on the plug body. The snagless telecommunications plug assembly facilitates removing the plug assembly without catching or snagging the latch beam on adjacent wiring or cables.

BACKGROUND OF THE INVENTION

In telecommunication systems, signals are transmitted over cables having a plug assembly at one end connected to a complementary mating connector. Such connections are often made in areas of trunking or patch panels, where space is extremely limited. The areas in which these connections are made have numerous wires or cables, electrical components and other electrical equipment that make inserting the plug assemblies into receiving jack assemblies difficult. Removal of the plug assemblies is also difficult due to the numerous wires, electrical components and other equipment that interfere with accessing the plug and removing the plug from the receiving jack assembly and through the associated wires, and electrical components and equipment.

One problem with existing telecommunications plug assemblies is that the plug latch tends to catch or snag other electrical wires, electrical components or other miscellaneous electrical equipment during the drawback of the plug assembly. The limited space within which all the wires, components and equipment must be installed creates a tight area through which the plug assembly must be drawn. Frequently, a plug latch with catch, engage or otherwise snag on an existing wire, component or other equipment in the area. If the snagged plug latch is continuously pulled in an attempt to free the plug assembly the latch can break, thereby ruining the plug assembly. A need exists for a telecommunications plug assembly that prevents snagging the plug latch upon removal and for protecting the plug latch.

Another problem with existing telecommunications plug assemblies is that it is difficult to access the plug latch to disengage the plug assembly from the complementary jack assembly. The numerous electrical wires, electrical components and other electrical equipment make it difficult to access and depress the latch to remove the plug assembly. Some existing telecommunications plug assemblies have snagless features that increase the difficulty of accessing and depressing the latch to remove the plug assembly. Therefore, a need exists for a snagless telecommunications plug assembly that does not increase the difficulty of accessing and depressing the plug latch.

Existing snagless telecommunications plugs are disclosed in U.S. Pat. No. 4,611,875 to Clarke et al.; U.S. Pat. No. 5,494,457 to Kunz; U.S. Pat. No. 5,638,474 to Lampert et al.; and U.S. Pat. No. 5,685,731 to Lin. Each of these patents discloses plug assemblies in which the latch beam is disposed between two ears that extend above the latch beam. The latch beam being positioned between two higher ears makes it difficult for the user's finger to get between the two ears to depress the plug latch sufficiently to disengage the plug assembly from the receiving jack assembly. Thus, the ears increase the difficulty of accessing and depressing the latch beam.

A need exists for a snagless telecommunications connector assembly.

SUMMARY OF THE INVENTION

Accordingly, it is a primary objective of the present invention to provide an improved snagless telecommunications connector assembly.

Accordingly, another objective of the present invention is to provide a snagless telecommunications plug assembly that prevents snagging of the plug latch upon withdrawal of the plug assembly from a receiving jack assembly.

Accordingly, another objective of the present invention is to provide a snagless telecommunications plug assembly in which the plug latch is easily accessible to quickly and easily disengage the plug assembly from a receiving jack assembly.

Accordingly, another object of the present invention is to provide a plug latch that extends above first and second ears on the plug body to provide easy access to the plug latch.

The foregoing objects are basically attained by providing a snagless telecommunications connector assembly, including a connector housing having front and rear ends, and an upper surface extending between the front and rear ends. A latch beam extends rearwardly from the front end of the connector housing over the upper surface. The latch beam is deflectable to disengage the connector assembly from a mated connection. First and second ears extend outwardly from the upper surface of the connector housing. Each of the first and second ears has a portion tapering toward the rear end of the housing. A rib extends outwardly from the latch beam. The first and second ears and the rib prevent the latch beam of the plug from becoming snagged during movement of the plug.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings that form a part of the original disclosure.

DETAILED DESCRIPTION OF THE INVENTION

Figure 1:
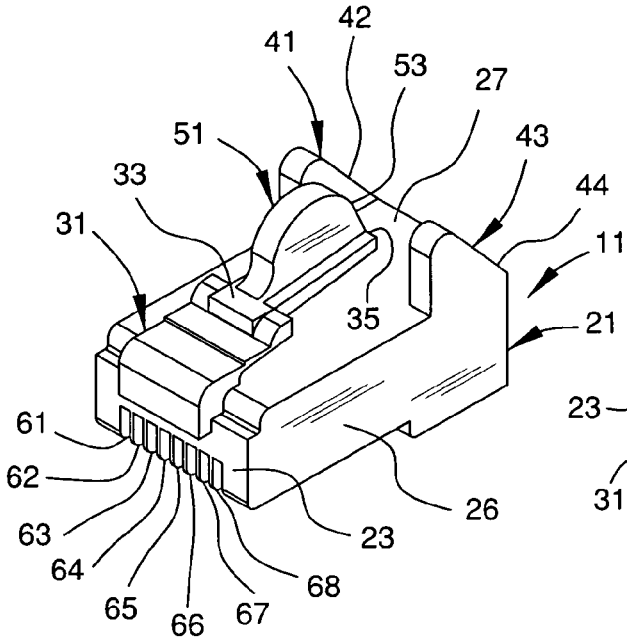
FIG. 1 is a perspective view of a snagless telecommunications plug assembly according to a first embodiment of the present invention in which a rib extends to a height above the first and second ears.

As shown in FIGS. 1–14, a snagless telecommunications connector assembly 11 has a connector housing 21 having a front end 23 and a rear end 25. An upper surface 27 extends between the front and rear ends. A latch beam 31 extends rearwardly from the front end 23 of the connector housing 21 adjacent to and over upper surface 27. The latch beam 31 is deflectable to disengage the connector assembly 11 from a mated connection. A first ear 41 and a second ear 43 extend outwardly from the upper surface 27 of the connector housing 21. Each of the first and second ears 41 and 43 has a portion tapering toward the rear end 25 of the housing 21. A rib 51 extends outwardly from the latch beam 31. The first and second ears 41 and 43 and the rib 51 prevent the latch beam 31 of the connector assembly 11 from becoming snagged during withdrawing movement of the connector assembly.

Preferably, the present invention relates to a modular plug assembly 11 for use in a 4, 6, 8 or 10 position interconnection device. The plug assembly 11 has raised, rounded, snagless ears 41 and 43 that extend upwardly from opposite sides of the connector housing 21. Each snagless ear 41 and 43 extends above the highest point of the latch release beam 31, allowing the plug to be threaded backwardly through an electrical wire or cable system without the latch beam "snagging" or catching on other wires, cables and components in the electrical system.

Figure 7:
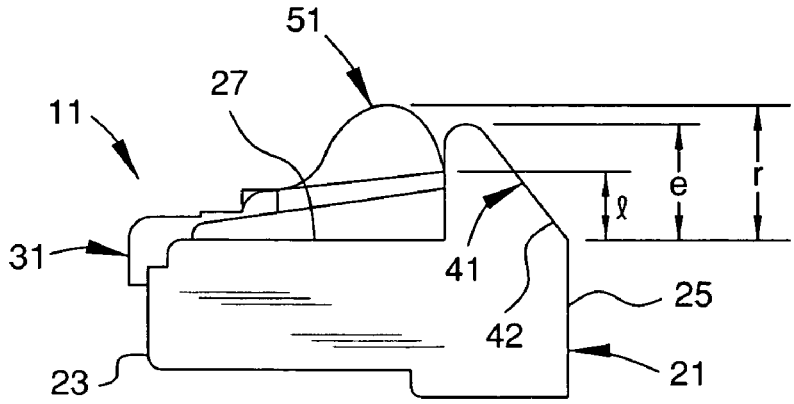
FIG. 7 is a side elevational view of the plug assembly of FIG. 1.

Additionally, the plug assembly 11 has a rounded, raised rib 51 on the latch release beam 31, which preferably extends above the highest point of the snagless ears 41 and 43 on the connector housing 21, as shown in FIG. 7. The rib 51 is contoured and raises the initial deflection position of the latch release beam 31, reducing the distance a finger or thumb is required to enter between the snagless ears 41 and 43 to fully disengage the latch beam. The raised rib 51 facilitates disengagement of the plug assembly 11 from a complementary mating connector.

An internal chamber 29 opens on the rear end 25 of the housing 21 and is defined by housing walls. The front and rear ends 23 and 25 of the connector housing 21 are connected by an upper surface, or top wall, 27, a bottom wall 28, and side walls 24 and 26.

Figure 2:
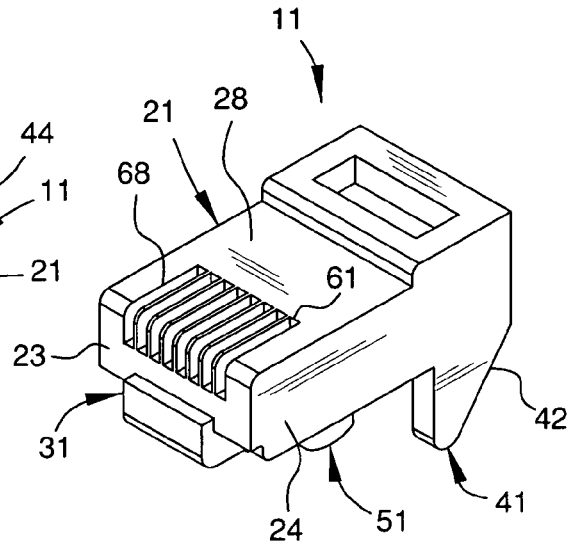
FIG. 2 is a bottom perspective view of the plug assembly of FIG. 1.
Figure 3:
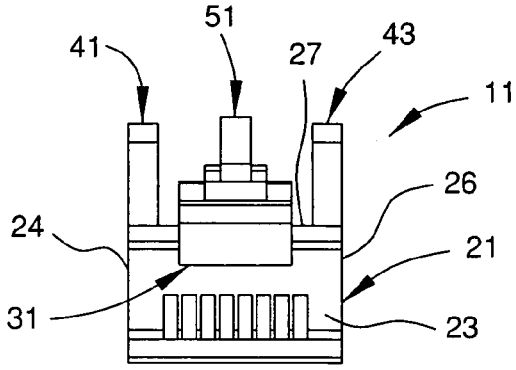
FIG. 3 is a front elevational view of the plug assembly of FIG. 1.
Figure 4:
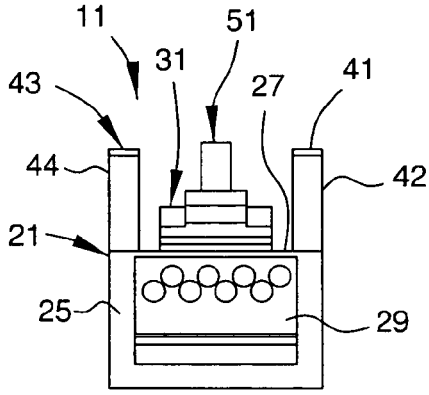
FIG. 4 is a rear elevational view of the connector of FIG. 1.
Figure 5:
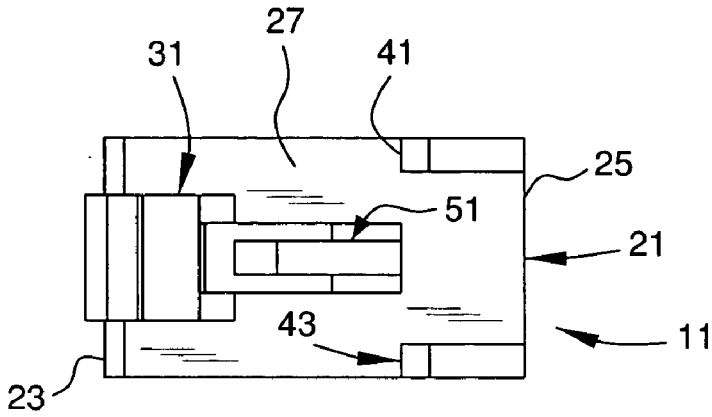
FIG. 5 is a top plan view of the plug assembly of FIG. 1.
Figure 6:
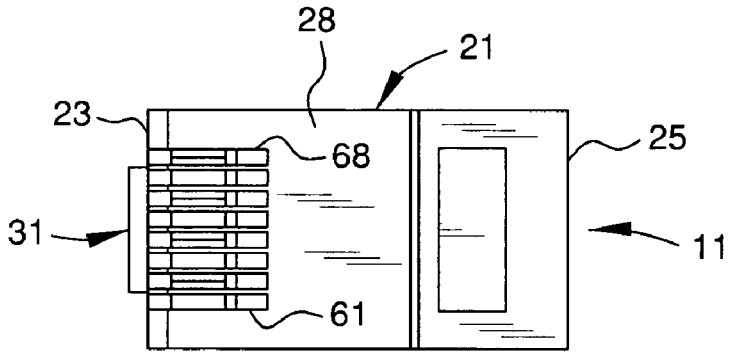
FIG. 6 is a bottom plan view of the plug assembly of FIG. 1.

A plurality of slots 61 extend through the housing walls adjacent to and open on the front end 23 and into the internal chamber 29. Preferably, the slots 61 are in the bottom wall 28 of the connector housing 21 and extend downwardly into the internal chamber 29, as shown in FIGS. 1 and 2. Preferably, there are eight slots 61–68. A plurality of conventional insulation displacement contacts (not shown) are mounted in the slots 61–68 for movement between retracted positions spaced from the internal chamber 29 and inserted positions extending into the internal chamber. Preferably, each slot 61–68 of the connector housing 21 receives an insulation displacement contact. After the cable wires are inserted within the internal chamber 29 of the connector housing 21, each of the insulation displacement contacts may be moved to its inserted position downwardly to engage and make mechanical and electrical contact with the conductors in the insulated wires.

A conventional latch beam 31 is connected to the housing to facilitate inserting and removing the plug housing from a receptacle, such as a jack assembly (not shown). Preferably, the latch beam 31 extends rearwardly, as shown in FIGS. 1–14. Preferably, the plug is an RJ45 type plug. The latch beam 31 is resilient so that the latch beam may be deflected to facilitate engaging and disengaging the latch beam with a complementary mated connector. An upper surface 33 of the latch beam 31 may be used for marking and/or port identification.

Figure 8:
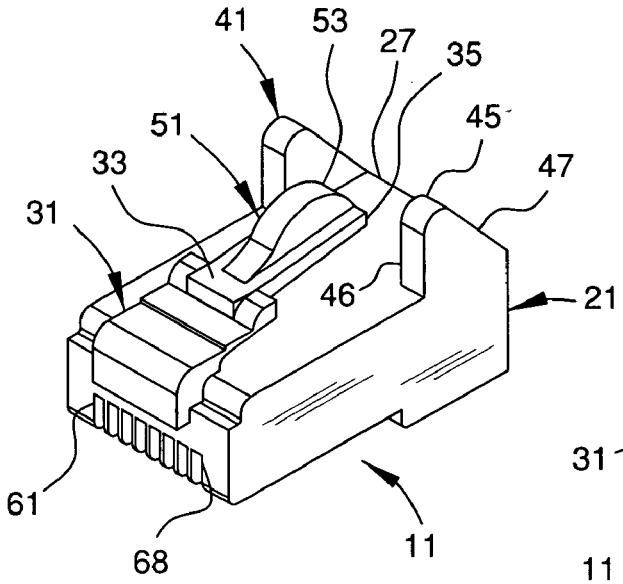
FIG. 8 is a perspective view of a snagless telecommunications plug assembly according to a second embodiment of the present invention in which the rib extends to substantially the same height as the first and second ears.
Figure 9:
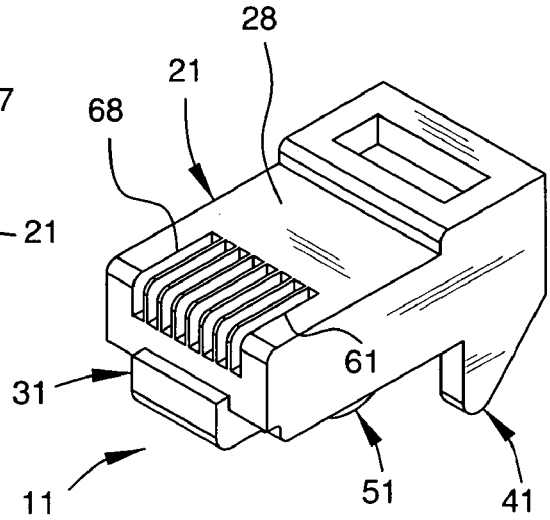
FIG. 9 is a bottom perspective view of the plug assembly of FIG. 8.
Figure 10:
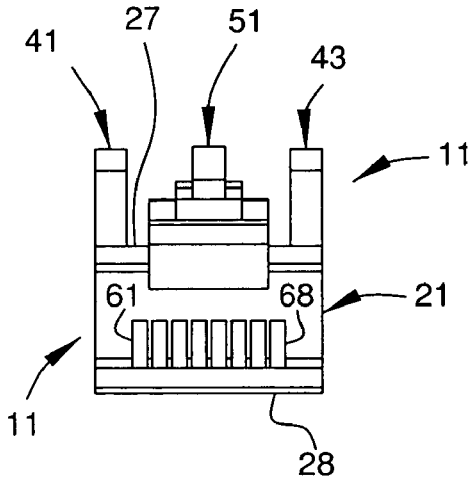
FIG. 10 is a front elevational view of the plug assembly of FIG. 8.
Figure 11:
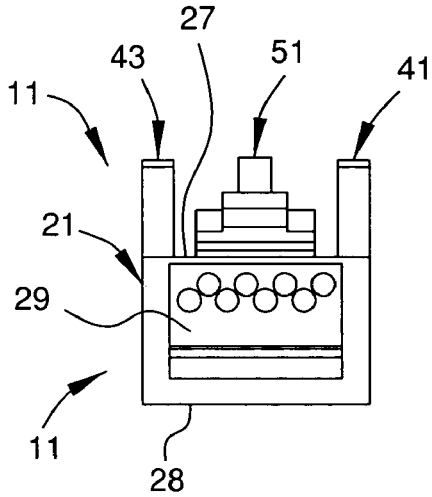
FIG. 11 is a rear elevational view of the connector of FIG. 8.
Figure 12:
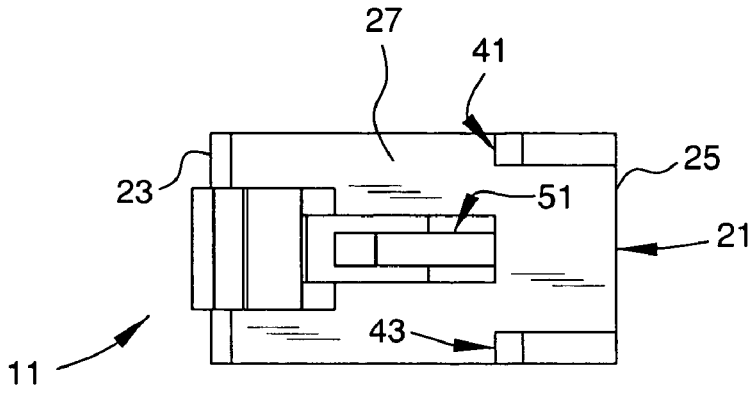
FIG. 12 is a top plan view of the plug assembly of FIG. 8.
Figure 13:
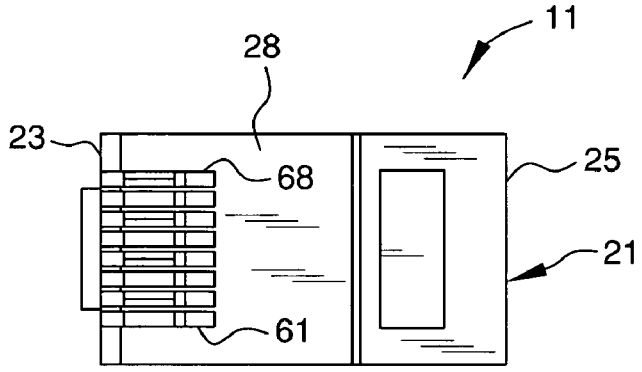
FIG. 13 is a bottom plan view of the plug assembly of FIG. 8.

First ear 41 and second ear 43 extend upwardly from the upper surface 27 of the connector housing 21, as shown in FIGS. 1–14. Preferably, the first ear 41 is substantially flush with one side wall 24, as shown in FIG. 2, and the second ear 43 is substantially flush with the other side wall 26, as shown in FIG. 1. Preferably, the first and second ears 41 and 43 extend upwardly substantially perpendicularly to the upper surface 27 of the connector housing 27. A first portion 42 of the first ear 41 and a second portion 44 of the second ear 43 taper inwardly toward the rear end 25 of the connector housing, as shown in FIG. 1. The ears are substantially V-shaped, having a first leg 46 and a second leg 47, as shown in FIG. 8. The first leg 46 extends substantially perpendicularly from the upper surface 27 of the connector housing 21, as shown in FIG. 8. The second leg 47 forms the first and second portions 42 and 44 of the first and second ears 41 and 43. The transition portion 45 between the first and second legs is substantially rounded, as shown in FIG. 8. The tapered and rounded contour and rigidity of the first and second ears 41 and 43 cause wires, cables, and other electrical components to pass over and around the connector housing 21 without snagging the latch beam 31. The first and second ears 41 and 43 extend a distance "e" above the upper surface 27 of the connector housing 21. Preferably, the distance "e" is greater than the distance "1" that the latch beam 31 extends above the upper surface 27 of the connector housing 21 to prevent snagging of the latch beam. Preferably, the first and second ears 41 and 43 are formed unitarily with the connector housing 21. The rear, free end 35 of latch beam 31 terminates adjacent a plane containing legs 46 of ears 41 and 43.

The rib 51 extends upwardly from the latch beam 31, as shown in FIGS. 1 and 8. Preferably, the rib 51 extends substantially perpendicularly from an upper surface 33 of the latch beam 31. Preferably, the rib 51 has a tapered rounded contour and is substantially rigid to prevent snagging the latch beam on various electrical wires, cable and miscellaneous components. Preferably, a portion 53 of the rib 51 tapers inwardly toward free end 35 of the latch beam 31, as shown in FIGS. 1 and 8. The rib 51 extends upwardly between first and second ears 41 and 43 to facilitate deflecting the latch beam with a user's finger. Preferably, the rib 51 is formed unitarily with the latch beam 31.

Figure 14:
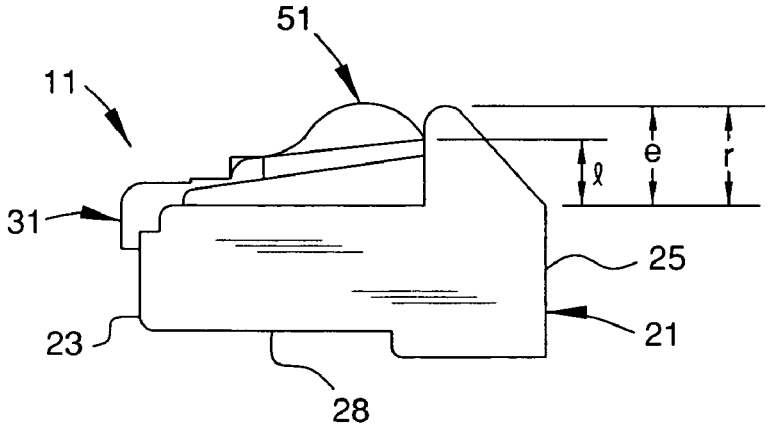
FIG. 14 is a side elevational view of the plug assembly of FIG. 8.

As shown in FIGS. 7 and 14, the rib 51 extends a height "r" above the upper surface 27 of the connector housing. In FIG. 7, the height "r" is greater than the height "e" of the first and second ears 41 and 43, thereby more easily allowing the user's finger to access the rib 51 to deflect the latch beam 31 for insertion and removal of the plug assembly 11 with a mating connector by reducing the distance the user's finger must enter between the first and second ears. The greater the height "r" of the rib 51 above the upper surface 27 of the connector housing 21, the greater the initial deflection position of the latch beam 31, and the less distance between the first and second ears 41 and 43 the user's finger must enter to disengage the latch beam. A plug assembly 11 in which the height "r" of the rib 51 is greater than the height "e" of the first and second ears 41 and 43 is shown in FIGS. 1–7. In FIGS. 8–14, the height "r" is substantially equivalent to the height "e" of the first and second ears 41 and 43, thereby still allowing easy access for the user's finger to deflect the latch beam 31 for insertion and removal of the plug assembly 11 with a mating connector. Identical reference numerals are used for the plug assemblies shown in FIGS. 1–7 and 8–14 since the only difference is the height "r" of the rib 51.

Assembly and Disassembly

As shown in FIGS. 1–7, the telecommunications plug assembly 11 of the present invention is shown having a rib 51 that extends above the first and second ears 41 and 43. As shown in FIGS. 8–14, the telecommunications plug assembly 11 of the present invention is shown having a rib 51 that extends to a height substantially equivalent to the height of the first and second ears 41 and 43.

The plug assembly 11 is matable with a complementary mating connector. Preferably, the plug assembly 11 is an RJ-45 plug assembly, and an appropriate complementary mating connector is a conventional RJ-45 jack assembly. When a mated plug assembly 11 is to be removed from a mating connector, the user inserts a finger, or any other suitable tool, between first and second ears 41 and 43 of the connector housing 21. As discussed above, the greater the height "r" of the rib 51 above the upper surface 27 of the connector housing 21, the more easily the user's finger is able to access the rib to deflect the latch beam 31 to disengage the plug assembly 11 from the mating connector. Once the latch beam 31 is deflected, the plug assembly 11 is pulled rearwardly away from the mating connector to mechanically and electrically disengage the plug assembly 11 from the mating connector.

The rib 51 and the first and second ears 41 and 43 facilitate the rearward movement of the plug assembly 11 to prevent snagging the latch beam 31 on the numerous wires, electrical components and other miscellaneous equipment in the area. The height "r" of the rib 51 and "e" of the first and second ears 41 and 43 above the height "1" of the latch beam 31, deflects the numerous wires, electrical components and other miscellaneous equipment safely above and over the latch beam, thereby allowing the plug assembly 11 to be pulled rearwardly without substantial risk of catching or snagging the latch beam. The rounded contours of the rib 51 and first and second ears 41 and 43 further facilitates the rearward movement of the plug assembly 11 without fear of catching or snagging the latch beam.

While advantageous embodiments have been chosen to illustrate the invention, it will be understood by those skilled in the art that various changes and modifications may be made therein without departing from the scope of the invention as defined in the appended claims.

What is claimed is:

1. A snagless telecommunications connector, comprising:

a unitarily formed connector housing having front and rear ends, and an upper surface extending between said front and rear ends;

a latch beam extending rearwardly from said front end of said housing over and adjacent said upper surface, said latch beam being deflectable to disengage said connector from a mated connection;

first and second ears extending outwardly from said upper surface, each of said first and second ears having a portion tapering toward said rear end of said housing, said first and second ears being unitarily formed with said connector housing; and a rib extending outwardly from said latch beam, a portion of said rib tapering toward a rear end of said latch beam.

2. A snagless telecommunications connector according to claim 1, wherein said connector is an RJ-45 plug.

3. A snagless telecommunications connector according to claim 1, wherein each of said first and second ears are flush with one of side walls of said connector housing.

4. A snagless telecommunications connector according to claim 1, wherein said rib extends higher than said first and second ears.

5. A snagless telecommunications connector according to claim 1, wherein said first and second ears extend from said upper surface above said latch beam.

6. A snagless telecommunications connector according to claim 1, wherein said latch beam and said rib extend rearwardly between said first and second ears.

7. A snagless telecommunications connector according to claim 1, wherein said rib is unitarily formed with said latch beam.

8. A snagless telecommunications connector according to claim 1, wherein said first and second ears extend substantially perpendicularly from said upper surface of said connector housing.

9. A snagless telecommunications connector according to claim 8, wherein each of said first and second ears is flush with a side wall of said connector housing.

10. A snagless telecommunications connector, comprising:

a connector housing having front and rear ends, and an upper surface extending between said front and rear ends;

a latch beam extending rearwardly from said front end of said housing over and adjacent said upper surface, said latch beam being deflectable to disengage said connector from a mated connection;

first and second ears extending outwardly from said upper surface, each of said first and second ears having a portion tapering toward said rear end of said housing; and a rib extending outwardly from said latch beam and at least as high as said first and second ears from said upper surface.

11. A snagless telecommunications connector according to claim 10, wherein said connector is an RJ-45 plug.

12. A snagless telecommunications connector according to claim 10, wherein said first and second ears extend above said latch beam.

13. A snagless telecommunications connector according to claim 10, wherein said first and second ears are formed unitarily with said connector housing.

14. A snagless telecommunications connector according to claim 10, wherein said first and second ears extend substantially perpendicularly from said upper surface of said connector housing.

15. A snagless telecommunications connector according to claim 10, wherein each of said first and second ears is flush with a side wall of said connector housing.

16. A snagless telecommunications connector according to claim 10, wherein a portion of said rib tapers toward a rear end of said latch beam.

17. A snagless telecommunications connector according to claim 10, wherein said rib is unitarily formed with said latch beam.

18. A snagless telecommunications connector according to claim 10, wherein said rib is unitarily formed with said latch beam.

19. A snagless RJ-45 plug, comprising:

a connector housing having front and rear ends, an upper surface extending between said front and rear ends, and side walls extending between said front and rear ends;

a latch beam extending rearwardly from said front end of said housing over and adjacent said upper surface, said latch beam being deflectable to disengage said connector from a mated connection;

first and second ears extending outwardly from said upper surface, each of said first and second ears having a first portion tapering outwardly from said upper surface of said housing and a second portion tapering toward said rear end of said housing, each of said first and second ears being flush with one of said side walls and extending higher than said latch beam; and a rib extending outwardly from said latch beam at least as high as said first and second ears from said upper surface, said latch beam and said rib extending rearwardly between said first and second ears.

20. A snagless telecommunications connector according to claim 19, wherein a portion of said rib tapers inwardly toward a rear end of said latch beam.

* * * * *